US008798511B2

(12) United States Patent
Ichihashi

(10) Patent No.: US 8,798,511 B2
(45) Date of Patent: Aug. 5, 2014

(54) IMAGE FORMING APPARATUS

(71) Applicant: Osamu Ichihashi, Sagamihara (JP)

(72) Inventor: Osamu Ichihashi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/028,082

(22) Filed: Sep. 16, 2013

(65) Prior Publication Data

US 2014/0016970 A1 Jan. 16, 2014

Related U.S. Application Data

(63) Continuation of application No. 12/762,678, filed on Apr. 19, 2010, now Pat. No. 8,571,450.

(30) Foreign Application Priority Data

Apr. 22, 2009 (JP) ..... 2009-103879

(51) Int. Cl.
*G03G 15/01* (2006.01)

(52) U.S. Cl.
USPC ..... 399/301; 399/302

(58) Field of Classification Search
USPC ..... 399/299, 302, 208
See application file for complete search history.

(56) References Cited

U.S. PATENT DOCUMENTS

| | | | |
|---|---|---|---|
| 7,020,415 | B2 | 3/2006 | Abe |
| 8,447,198 | B2 | 5/2013 | Fujita et al. |

FOREIGN PATENT DOCUMENTS

| | | |
|---|---|---|
| JP | 11-24507 | 1/1999 |
| JP | 2004-177507 | 6/2004 |
| JP | 2004-287337 | 10/2004 |
| JP | 2005-148302 | 6/2005 |
| JP | 4021717 | 10/2007 |

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes a plurality of N image carriers including first through Nth image carriers, a transfer unit including an endless transfer belt, a plurality of M belt supporting members including a plurality of first through Nth nip opposing members contacting the inner surface of the endless transfer belt at positions corresponding to where the plurality of N image carriers contacts the outer surface of the endless transfer belt to form N transfer nips thereat, the first opposing member defining a first supported area of the endless transfer belt, a contact and separation mechanism including a retaining unit to move the first supported area of the endless transfer belt into and out of contact with the first image carrier, and a mark detector to detect a plurality of adjacent marks formed at a predetermined pitch in a circumferential direction of the endless transfer belt.

12 Claims, 6 Drawing Sheets

IMAGE FORMING APPARATUS

CROSS-REFERENCE TO RELATED APPLICATIONS

The present application is a continuation of U.S. patent application Ser. No. 12/762,678, filed on Apr. 19, 2010, which claims priority pursuant to 35 U.S.C. §119 from Japanese Patent Application No. 2009-103879, filed on Apr. 22, 2009 in the Japan Patent Office, the contents of each of which are hereby incorporated by reference in their entirety.

BACKGROUND OF THE INVENTION

1. Field of the Invention

Exemplary embodiments of the present invention relate to a tandem-type image forming apparatus for transferring toner images formed on multiple image carriers onto a belt member or a recording medium to form a composite color image.

2. Discussion of the Related Art

Tandem-type image forming apparatuses generally have a transfer nip that is a contact area formed between each of multiple image carriers and a belt member held in contact with the multiple image carriers. Respective single-color toner images formed on the multiple image carriers are transferred sequentially onto either the belt member or a recording medium carried on the belt member at the respective transfer nips to form a multi-color or composite color toner image.

In this configuration, the belt member is driven at a constant speed by a belt drive motor. However, the speed of the belt member can vary due to, for example, eccentricity of extension rollers that extend to tension the belt member, eccentricity of drive gears, and/or uneven thickness in a circumferential direction of the belt member. If the speed of the belt member varies during a primary transfer operation for overlaying toner images on the belt member, the colors of the toner images may be displaced or shifted, resulting in significant deterioration in image quality or production of defective images.

Some image forming apparatuses employing a tandem-type image forming units include technologies to suppress occurrence of the above-described color shift caused by fluctuation in the velocity of the belt member. For example, the image forming apparatus may include a belt member with a scale formed thereon. The scale includes multiple marks formed at given pitches in the circumferential direction of the belt member. The image forming apparatus also includes a scale sensor to detect the multiple marks of the scale. A controller then detects the speed of the belt member based on time intervals between successive detections of the scale marks, and based on the detection results, controls the drive speed of a belt drive motor to reduce fluctuation in the velocity of the belt member.

Although generally successful, the related-art image forming apparatus having the above configuration cannot completely reduce or prevent color shift because fluctuation in the velocity of the belt member does not occur equally over the entire circumferential length of the belt member, as illustrated, for example, in FIG. 1.

FIG. 1 illustrates a configuration of a transfer unit 200 incorporated in a related-art image forming apparatus.

The transfer unit 200 includes a transfer belt member 201 that is supported by a drive roller 202 disposed to an inner surface of the transfer belt member 201, a driven roller 203, a tension roller 204, and four primary transfer rollers 205*a*, 205*b*, 205*c*, and 205*d*. With this configuration, the surface speed of the belt member at each of the transfer nips formed between photoconductors 210*a*, 210*b*, 210*c*, and 210*d* and the primary transfer rollers 205*a*, 205*b*, 205*c*, and 205*d*, respectively, depends on which area of the transfer belt member 201 enters the position where the transfer belt member 201 is wound around the drive roller 202.

Specifically, the transfer belt member 201 may have at least an uneven thickness in the circumferential direction thereof. Further, the drive roller 202 and the tension roller 204 may be slightly eccentrically mounted on their shafts. In addition, the speed of the transfer belt member 201 at each transfer nip can also fluctuate due to the eccentricity of the drive roller 202. Therefore, the fluctuation in the velocity of the transfer belt member 201 that is observed at each transfer nip is a combination or superimposition of a component of fluctuation in the belt velocity due to the thickness fluctuation of the transfer belt member 201 and a component of fluctuation in the belt velocity due to eccentricity of the drive roller 202.

Accordingly, the surface speed of the transfer belt member 201 may vary at each transfer nip. However, the surface speed of the transfer belt member 201 may be different at the transfer nips and in a belt tensioned area between the tension roller 204 and the driven roller 203, because the speed of the transfer belt member 201 varies in the belt tensioned area due to the fluctuation in belt thickness at the belt wound area of the drive roller 202 and the eccentricity of the drive roller 202 and due to the fluctuation in the belt thickness at the belt wound area of the tension roller 204 and the eccentricity of the tension roller 204. In the belt tensioned area, the velocity fluctuation in which these velocity fluctuations are superimposed onto each other may occur on the surface of the transfer belt member 201.

Further, it is typical to provide a contact and separation mechanism to move the transfer belt member 201 into and out of contact with the photoconductors for yellow, magenta, and cyan toner images. In the configuration with the contact and separation mechanism, regardless of the operations performed by the contact and separation mechanism, it is preferable that the scale sensor detects the multiple marks of the scale formed on the transfer belt member.

SUMMARY OF THE INVENTION

Exemplary aspects of the present invention have been made in view of the above-described circumstances.

Exemplary aspects of the present invention provide an image forming apparatus that can effectively avoid unnecessary driving of photoconductors and prevent color shifting caused by the fluctuation of velocity of a belt member by detecting marks of a scale formed on the belt member accurately regardless of movement of a contact and separation mechanism.

In one exemplary embodiment, an image forming apparatus includes a plurality of N image carriers, a transfer unit, a plurality of M belt supporting members, a contact and separation mechanism, and a mark detector. The plurality of N image carriers, including first through Nth image carriers, carries toner images formed thereon, satisfying a relation of $N \geq 2$. The transfer unit includes an endless transfer belt an outer surface of which contacts the plurality of N image carriers, to successively transfer the toner images formed on the plurality of N image carriers onto either the outer surface of the endless transfer belt or a surface of a recording medium carried on the endless belt. The plurality of M belt supporting members are disposed in contact with an inner surface of the endless transfer belt to support the endless transfer belt, satisfying a relation of $M>N$. The plurality of M belt supporting members include a plurality of first through Nth nip opposing members contacting the inner surface of the endless transfer belt at positions corresponding to where the plurality of N image carriers contact the outer surface of the endless transfer belt to form N transfer nips thereat. The first nip opposing member defines a first supported area of the endless transfer belt in a circumferential direction thereof where the first nip opposing member contacts and supports the endless transfer belt. The contact and separation mechanism includes a retaining unit that supports at least the first nip opposing member and moves the retaining unit to move the first supported area of the endless transfer belt into and out of contact with the first image carrier. The mark detector is provided in proximity to the endless transfer belt, fixedly mounted on the retaining unit, and moved by the contact and separation mechanism together with the retaining unit that supports at least the first nip opposing member. The mark detector detects a plurality of adjacent marks formed at a predetermined pitch on the endless transfer belt in the circumferential direction of the endless transfer belt.

The above-described image forming apparatus may further include a controller operatively connected to the mark detector and to a motor that drives the endless transfer belt.

The controller may control the motor speed to control a drive speed of the endless transfer belt based on detection results obtained by the mark detector.

The first nip opposing member and the first nip opposing member together may form an extreme downstream nip of the N transfer nips in a direction of rotation of the endless transfer belt with the endless transfer belt interposed therebetween. The retaining unit may include a first sub-retainer that retains the first nip opposing member and a second sub-retainer that retains the plurality of N nip opposing members other than the first nip opposing member. The contact and separation mechanism may include a first contact and separation unit to contact and separate the first supported area of the endless transfer belt to and from the first image carrier and a second contact and separation unit to contact and separate a second supported area of the endless transfer belt different from the first supported area and defines by where the plurality of N image carriers other than the first image carrier contacts the endless transfer belt to and from the plurality of N image carriers other than the first image carrier. The mark detector may be fixedly mounted on the first sub-retainer.

A black toner image may be transferred from one of the plurality of N image carriers onto one of the outer surface of the endless transfer belt and the recording medium at the extreme downstream transfer nip.

An extreme upstream belt supporting member may be disposed adjacent to and upstream from the Nth nip opposing member in the direction of rotation of the endless transfer belt and fixedly mounted on the second sub-retainer. The Nth nip opposing member and the Nth image carrier together may form an extreme upstream transfer nip with the endless transfer belt interposed therebetween. An extreme downstream belt supporting member may be disposed adjacent to and downstream from the first nip opposing member in the direction of rotation of the endless transfer belt and fixedly mounted on the first sub-retainer. The endless transfer belt may be tensioned in a straight line by and between the extreme upstream belt supporting member and the extreme downstream belt supporting member in the direction of rotation of the endless transfer belt.

A second upstream belt supporting member may be disposed adjacent to and upstream from the first nip opposing member in the direction of rotation of the endless transfer belt, and the first nip upstream member may be fixedly mounted on the first sub-retainer.

The mark detector may be fixedly mounted on the first sub-retainer to detect the plurality of marks formed on the endless transfer belt while the plurality of marks pass through a mark detection range defined by the belt supporting members. The mark detection range may extend from an area supported by the second upstream belt supporting member to an area supported by the extreme downstream belt supporting member in the direction of rotation of the endless transfer belt.

The plurality of marks may be arranged on the inner surface of the endless transfer belt and the mark detector may be fixedly mounted on the first sub-retainer to detect the plurality of marks in the mark detection range on the inner surface of the endless transfer belt.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
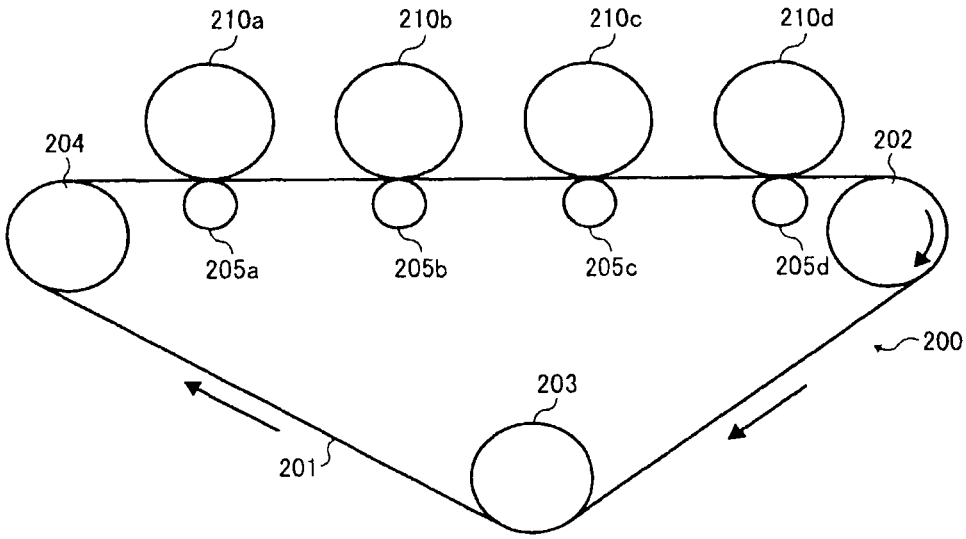
FIG. 1 BACKGROUND ART
FIG. 1 is an enlarged view of a schematic view of a belt unit incorporated in a related-art image forming apparatus.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
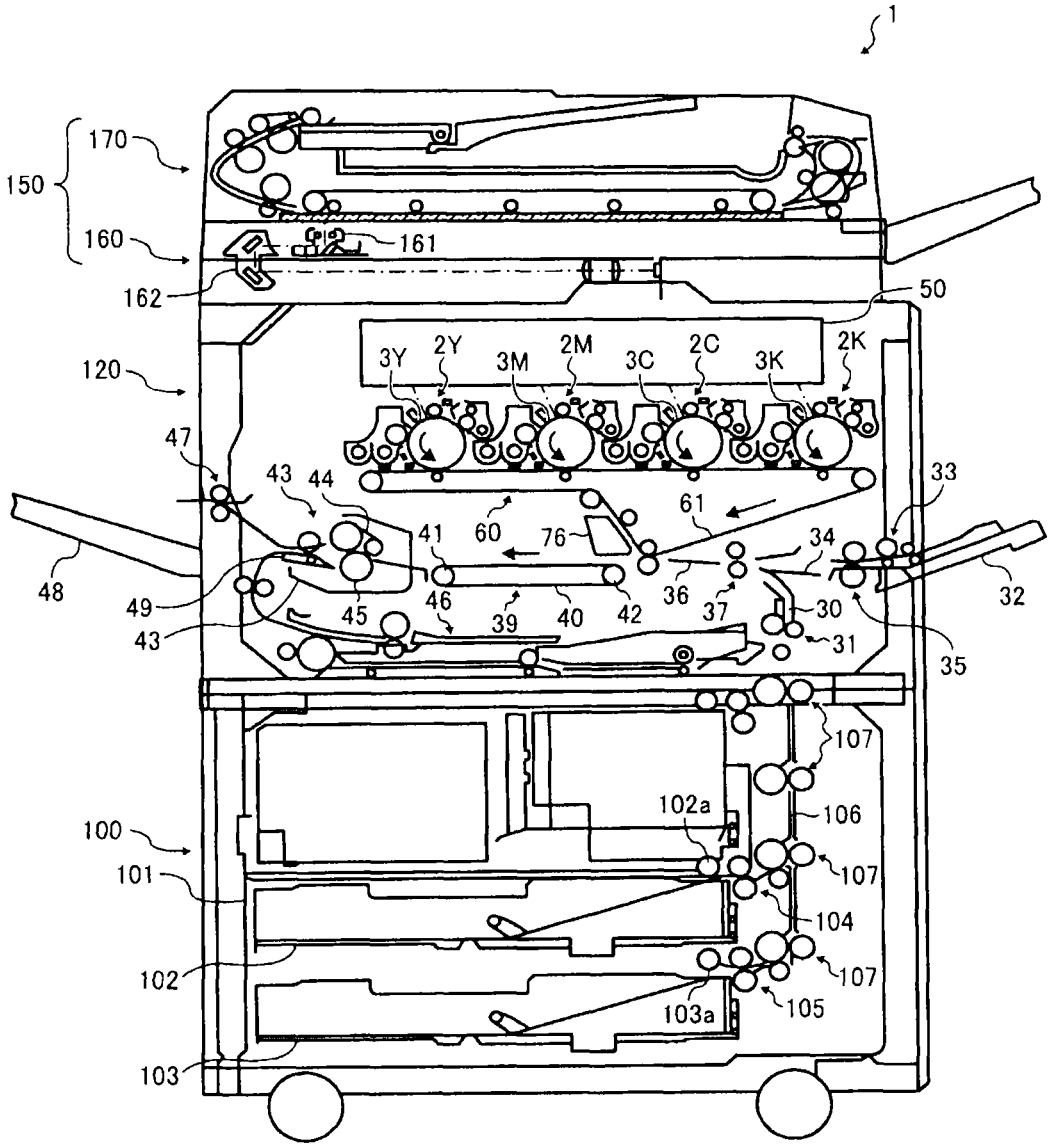
FIG. 2 is a schematic configuration of an image forming apparatus according to an exemplary embodiment of the present invention.

FIG. 2 illustrates a schematic configuration of an image forming apparatus 1 according to an exemplary embodiment of the present invention.

With reference to FIG. 2, basic configuration and operations of the image forming apparatus 1 are described.

The image forming apparatus 1 can be any of a copier, a printer, a facsimile machine, a plotter, and a multifunction printer including at least one of copying, printing, scanning, plotter, and facsimile functions. In this non-limiting example embodiment, the image forming apparatus 1 functions as a full-color copying machine employing a tandem-type image forming mechanism with an intermediate transfer belt for electrophotographically forming a toner image based on image data on a recording medium (e.g., a transfer sheet).

The toner image is formed with four single toner colors, which are yellow, magenta, cyan, and black. Reference symbols "Y", "M", "C", and "K" represent yellow color, magenta color, cyan color, and black color, respectively.

Since units and components with respective suffixes generally have similar configurations to each other, except for the colors of toners, it is also referred to without specific suffixes. At the same time, components and units provided in devices are denoted by common reference numerals without suffixes "Y", "M", "C", and "K" that are generally used to distinguish the colors.

In FIG. 2, the image forming apparatus 1 includes a printing section 120, a sheet feeding section 100, and a document feeding and reading unit 150 that includes a scanner 160 and an automatic document feeder or ADF 170. The scanner 160 that serves as a document reading device is fixedly mounted on the lower part of the printing section 120 to support the ADF 170.

The sheet feeding section 100 illustrated in FIG. 2 includes a paper bank 101, two sheet feeding cassettes 102 and 103 disposed inside the paper bank 101, pairs of sheet separation rollers 104 and 105, a sheet feeding path 106, and multiple pairs of conveyance rollers 107.

The sheet feeding cassettes 102 and 103 accommodate respective stack of paper sheets or recording sheets therein.

According to control signals transmitted from the printing section 120, one of the sheet feed rollers 102*a* and 103*a* is rotated to feed a recording sheet S placed on top of the stack of recording sheets accommodated in a corresponding one of the sheet feeding cassettes 102 and 103 toward the sheet feeding path 106. The recording sheet S fed from the sheet feeding cassettes 102 and 103 is separated from the stack of recording sheets by a corresponding one of the pairs of sheet separation rollers 104 and 105 and is conveyed into the sheet feeding path 106. The recording sheet S is then conveyed via transfer nips formed between the rollers of the multiple pairs of conveyance rollers 107 in the sheet feeding path 106 to a first branched path 30 of the printing section 120.

The printing section 120 further includes four process units 2Y, 2M, 2C, and 2K for forming yellow (Y), magenta (M), cyan (C), and black (K) toner images, the first branched path 30, a pair of sheet conveyance rollers 31, a manual sheet tray 32, a pickup roller 33, a second branched path 34, a separation roller 35, a pre-transfer conveyance path 36, a pair of registration rollers 37, a sheet conveyance belt unit 39, a fixing unit 43, a switchback unit 46, a pair of discharging rollers 47, a discharging tray 48, a switching claw 49, an optical writing unit 50, and a transfer unit 60. The process units 2Y, 2M, 2C, and 2K further include drum-shaped photoconductors 3Y, 3M, 3C, and 3K, respectively. The photoconductors 3Y, 3M, 3C, and 3K serve as a plurality of N image carriers, satisfying a relation of $N \geq 2$.

The pre-transfer conveyance path 36 that conveys the recording sheet S is divided into two branches, which are a first branched path 30 and a second branched path 34, at an upstream side from a position immediately before a secondary transfer nip, which will be described later. The recording sheet S that is conveyed out of the sheet feeding path 106 of the sheet feeding section 100 enters the first branched path 30, then passes through a sheet conveyance nip formed between the pair of sheet conveyance rollers 31 disposed in the first branched path 30 to the pre-transfer conveyance path 36.

The manual sheet tray 32 is mounted on one side of a housing of the printing section 120 in a manner openable and closable to the housing. The manual sheet tray 32 is opened to manually feed the recording sheet S of a stack of recording sheets placed on the manual sheet tray 32. The recording sheet S placed on top of the stack of recording sheets on the manual sheet tray 32 is picked up by the pickup roller 33, separated one by one by the separation roller 35, and conveyed to the second branched path 34. Then, the recording sheet S is conveyed via a registration nip formed between the pair of registration rollers 37 to the pre-transfer conveyance path 36.

The optical writing unit 50 of the image forming apparatus 1 of FIG. 2 includes a laser diode, a polygon mirror, and various lenses. The laser diode is driven based on image data read by the scanner 160, which is described later, or image data transmitted by an external personal computer to optically scan the photoconductors 3Y, 3M, 3C, and 3K of the process units 2Y, 2M, 2C, and 2K, respectively.

More particularly, the photoconductors 3Y, 3M, 3C, and 3K of the process units 2Y, 2M, 2C, and 2K are driven by respective drive units, not illustrated, to rotate in a counter-clockwise direction in FIG. 2. The optical writing unit 50 emits a laser light beam L (see FIG. 3) to the photoconductors 3Y, 3M, 3C, and 3K during rotation to irradiate respective surfaces of the photoconductors 3Y, 3M, 3C, and 3K in an axial direction as the photoconductors 3Y, 3M, 3C, and 3K rotate in a sheet traveling direction. With this action, an electrostatic latent image based on the image data of yellow, magenta, cyan, and black single color images are formed on the respective surfaces of the photoconductors 3Y, 3M, 3C, and 3K.

Figure 3:
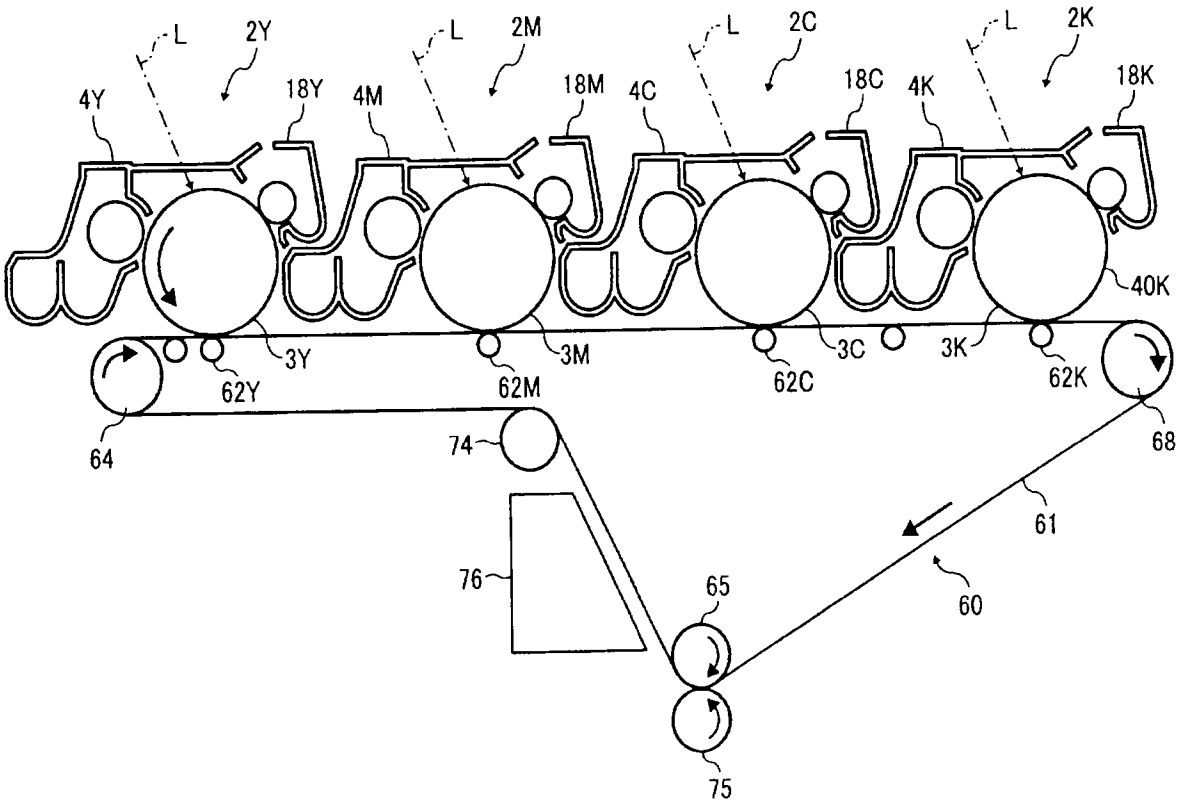
FIG. 3 is an enlarged view of a part of an internal configuration of a printing section of the image forming apparatus of FIG. 2.

FIG. 3 is an enlarged view of a part of an internal configuration of the printing section 120.

In FIG. 3, each of the process units 2Y, 2M, 2C, and 2K integrally includes a corresponding one of the photoconductors 3Y, 3M, 3C, and 3K, and various image forming components and units disposed therearound as one unit supported by a common supporting member. The process units 2Y, 2M, 2C, and 2K are removably installed to the image forming apparatus 1 and the units and components of the process units 2Y, 2M, 2C, and 2K generally have similar configurations to each other, except for the toner colors. For example, the process unit 2Y that forms a yellow toner image includes the photoconductor 3Y, a developing unit 4Y to develop an electrostatic latent image for yellow toner color formed on the surface of the photoconductor 3Y into a yellow toner image.

The image forming apparatus 1 according to an exemplary embodiment of the present invention is a tandem-type image forming apparatus in which four process units (e.g., the process units 2Y, 2M, 2C, and 2K) are arranged along a direction of endless rotation of an intermediate transfer belt 61, which is described later.

Figure 4:
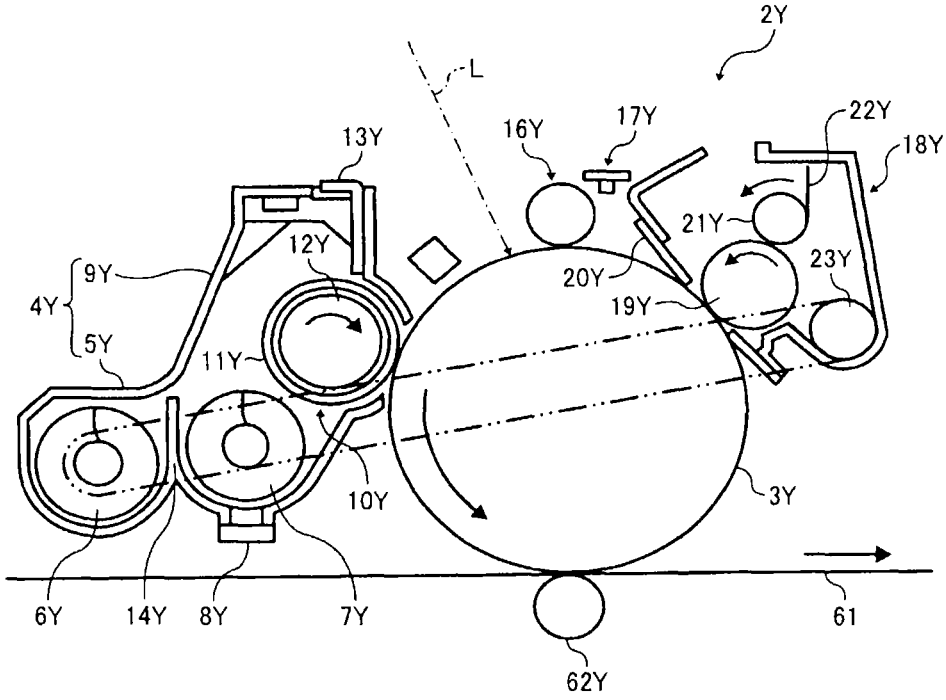
FIG. 4 an enlarged view of a process unit of the printing section of FIG. 3.

FIG. 4 illustrates an enlarged view of the process unit 2Y incorporated in the image forming apparatus 1 according to an exemplary embodiment of the present invention.

As noted above, the units and components with respective suffixes generally have similar configurations to each other, except for the colors of toners. Therefore, even though the following description is given of a configuration of the process unit 2Y, the description is also applied to the other configurations of the process units 2M, 2C, and 2K.

The process unit 2Y of FIG. 4 includes the photoconductor 3Y and other image forming components and units such as the developing unit 4Y, a photoconductor cleaning unit 18Y, an electric discharging lamp 17Y, and a charging roller 16Y arranged around the photoconductor 3Y.

The photoconductor 3Y is a drum-shaped image carrier that is formed by a base tube covered by a photoconductive layer formed of photoconductive organic photoconductive material. Alternative to the drum-shaped photoconductor, an endless belt-shaped image carrier can be employed as the photoconductor 3Y.

The developing unit 4Y of the process unit 2Y illustrated in FIG. 4 employs a two-component developer to develop the electrostatic latent image into a visible toner image. The two-component developer, which is hereinafter referred to as a developer, includes magnetic carrier particles and non-magnetic yellow toner particles. The development 4Y further includes an agitation compartment 5Y for agitating the developer accommodated therein and a development compartment 9Y for developing the electrostatic latent image formed on the photoconductor 3Y into the visible toner image. Alternative to the two-component developer, a single-component developer that consists essentially of non-magnetic toner particles can be applied.

The agitation compartment 5Y is located below or at a lower position than the development compartment 9Y and includes a first conveyance screw 6Y, a second conveyance screw 7Y, a partition plate 14Y, a toner density sensor 8Y. The first conveyance screw 6Y and the second conveyance screw 7Y are located side by side in a horizontal manner with the partition plate 14Y interposed therebetween. The toner density sensor 8Y is mounted on the bottom of a casing of the process unit 2Y.

The development section 9Y includes a developing roller 10Y and a doctor blade 13Y.

The doctor blade 13Y is provided in proximity to the developing roller 10Y so that the leading edge of the doctor blade 13Y can nearly contact the developing roller 10Y.

The developing roller 10Y is disposed facing the photoconductor 3Y, exposed to the photoconductor 3Y via an opening of the casing of the process unit 2Y. The developing roller 10Y includes a development sleeve 11Y and a magnet roller 12Y.

The development sleeve 11Y has a tubular shape formed by non-magnetic material, and the magnet roller 12Y is disposed inside or covered by the development sleeve 11Y. The magnet roller 12Y does not rotate and includes multiple magnets arranged in a circumferential direction thereof. The multiple magnets exert magnetic forces at respective predetermined positions in a direction of rotation of the developing roller 10Y, with respect to the developer held on a surface of the development sleeve 11Y so that the developer conveyed from the agitation compartment 5Y can be attracted to the surface of the development sleeve 11Y to form a magnetic brush along lines of the magnetic force on the surface of the development sleeve 11Y.

The magnetic brush formed on the surface of the development sleeve 11Y is regulated to an appropriate thickness when the surface of the development sleeve 11Y passes by a position facing the doctor blade 13Y as the development sleeve 11Y rotates. The regulated magnetic brush then directs to a development area that is formed at a position facing the photoconductor 3Y to perform development. In the development area, a development bias that is applied to the development sleeve 11Y and an electrostatic latent image formed on the photoconductor 3Y have a difference in electric potential therebetween, and the difference in electric potential enables the yellow toner in the magnetic brush on the surface of the development sleeve 11Y to move to the electrostatic latent image for developing into the toner image. As the development sleeve 11Y further rotates, the yellow toner is conveyed back to the development compartment 9Y to be released from the surface of the development sleeve 11Y according to the action of repulsion between magnetic fields formed between magnetic poles of the magnet roller 12Y. The yellow toner is then returned to the agitation compartment 5Y. According to detection results of the toner density sensor 8Y, an appropriate amount of yellow toner is supplied to the developer accommodated in the agitation compartment 5Y.

The photoconductor cleaning unit 18Y employs one of widely used configurations, for example, in which the cleaning blade 20Y including a rubber elastomer such as polyurethane rubber is pressed against the surface of the photoconductor 3Y. In order to enhance the cleaning ability or cleanability, the image forming apparatus 1 employs a fur brush 19Y whose circumferential surface contacts the photoconductor 3Y is rotatably disposed in a direction indicated by arrow shown in FIG. 4. The fur brush 19Y is also used to apply powder lubricant scraped from a solid lubricant, not illustrated, to the surface of the photoconductor 3Y.

The toner adhering to the fur brush 19Y is moved to an electric field roller 21Y to which a bias voltage is applied while rotating and contacting the fur brush 19Y in a counter direction. The toner is then scraped from electric field roller 21Y by a scraper 22Y to fall onto a toner collection screw 23Y.

The toner collection screw 23Y conveys the collected toner toward the end of the photoconductor cleaning unit 18Y in a direction perpendicular to the surface of the drawing sheet of FIG. 4, to an external recycling conveyance unit, not illustrated. The external recycling conveyance unit conveys the collected toner to the developing unit 4Y for recycling.

The electric discharging lamp 17Y electrically discharges the surface of the photoconductor 3Y by emitting light. The discharged surface of the photoconductor 3Y is uniformly charged by the charging roller 16Y, and then exposed by the optical writing unit 50. The charging roller 16Y rotates while receiving a charge bias supplied by a power source, not illustrated.

Alternative to the charging method using the charging roller 16Y, a scorotron charger method for charging the surface of the photoconductor 3Y without contacting can be employed.

By using the above-described processes in the configuration as shown in FIG. 3, the yellow, magenta, cyan, and black toner images are formed on the respective surfaces of the photoconductors 3Y, 3M, 3C, and 3K of the process units 2Y, 2M, 2C, and 2K.

The transfer unit 60 is disposed below the process units 2Y, 2M, 2C, and 2K. The transfer unit 60 includes the intermediate transfer belt 61 that serves as an endless transfer belt spanned around and extended by multiple belt supporting rollers. The intermediate transfer belt 61 is rotated endlessly by a drive roller 68 in a clockwise direction while contacting the photoconductors 3Y, 3M, 3C, and 3K. By so doing, respective primary transfer nips NY, NM, NC, and NK shown in FIG. 5 that are contact areas between the photoconductors 3Y, 3M, 3C, and 3K and the intermediate transfer belt 61.

In a vicinity of the primary transfer nips NY, NM, NC, and NK where yellow, magenta, cyan, and black toner images are formed, primary transfer rollers 62Y, 62M, 62C, and 62K are disposed contacting an inner surface of the intermediate transfer belt 61 and held to contact the photoconductors 3Y, 3M, 3C, and 3K with the intermediate transfer belt 61 interposed therebetween. That is, the primary transfer rollers 62Y, 62M, 62C, and 62K are pressed against the intermediate transfer belt 61.

A power source, not illustrated, applies a primary bias voltage to each of the primary transfer rollers 62Y, 62M, 62C, and 62K that serve as nip opposing members. With this configuration, a primary transfer electric field that a single color toner image formed on each of the photoconductors 3Y, 3M, 3C, and 3K onto the intermediate transfer belt 61 at the primary transfer nips NY, NM, NC, and NK for forming yellow, magenta, cyan, and black toner images.

As the intermediate transfer belt 61 rotates endlessly in a clockwise direction in FIG. 3 and passes through the primary transfer nips NY, NM, NC, and NK for the yellow, magenta, cyan, and black toner images, the respective single color toner images formed on the photoconductors 3Y, 3M, 3C, and 3K are sequentially transferred onto an outer surface of the intermediate transfer belt 61 for primary transfer so as to form a four-color or multi-color toner image thereon.

A secondary transfer roller 75 is located below the intermediate transfer belt 61 in FIG. 3. The secondary transfer roller 75 is disposed contacting the outer surface of the intermediate transfer belt 61 and facing the transfer roller opposing roller 65 with the intermediate transfer belt 61 interposed therebetween. According to this configuration, the secondary transfer roller 75 and the transfer roller opposing roller 65 form a secondary transfer nip therebetween.

Either the transfer roller opposing roller 65 disposed contacting the inner surface of the intermediate transfer belt 61 and or secondary transfer roller 75 disposed outside the loop of the intermediate transfer belt 61 is applied with a secondary transfer electric bias by a power source, not illustrated, and the other of which is electrically grounded. Accordingly, a secondary transfer electric field is generated in the secondary transfer nip.

On the right side of the secondary transfer nip in FIG. 3, the pair of registration rollers, which is not shown in this figure, is disposed so that the recording sheet S nipped between the rollers is conveyed to the secondary transfer nip in synchronization with movement of the four-color toner image formed on the intermediate transfer belt 61. In the secondary transfer nip, the four-color toner image formed on the intermediate transfer belt 61 is transferred onto the recording sheet S by the action of the secondary transfer electric field and the nip pressure for secondary transfer. Thus, the four-color toner image is combined with white color of the recording sheet and a full-color image is formed.

After passing through the secondary transfer nip, the outer surface of the intermediate transfer belt 61 carries residual toner that has not been transferred onto the recording sheet at the secondary transfer nip. The residual toner is removed by a belt cleaning unit 76 that presses against the intermediate transfer belt 61, thereby cleaning the outer surface of the intermediate transfer belt 61.

As previously shown in FIG. 2, the recording sheet that serves as a recording medium after passing through the secondary transfer nip is separated from the intermediate transfer belt 61 then conveyed to the sheet conveyance belt unit 39. The sheet conveyance belt unit 39 includes an endless sheet conveyance belt 40, a drive roller 41, and a driven roller 42. The endless sheet conveyance belt 40 is rotated by rotation of the drive roller 41 in a counterclockwise direction in FIG. 2 while being wound and tensioned around the drive roller 41 and the driven roller 42. Then, while holding the recording sheet received from the secondary transfer nip on a tensioned upper surface of the endless sheet conveyance belt 40, the sheet conveyance belt unit 39 conveys the recording sheet to a fixing unit 43 according to the rotation of the rotation thereof.

The fixing unit 43 includes a fixing belt 44 tensioned by a drive roller and a heat roller that includes a heat source, and rotates the fixing belt 44 in a clockwise direction as the drive roller rotates. A pressure roller 45 disposed below the fixing belt 44 is held in contact against a tensioned lower surface of the fixing belt 44. The full-color image formed on the recording sheet conveyed to the fixing unit 43 is fixed to the recording sheet by application of heat and pressure. Then, the recording sheet having the full-color image thereon is conveyed from the fixing unit 43 toward the switching claw 49.

The switching claw 49 swings by the action of a solenoid, not shown, to switch the recording sheet conveyance path between a sheet discharging path and a switchback path. If the switching claw 49 is set to direct to the sheet discharging path, the recording sheet conveyed from the fixing unit 43 passes through the sheet discharging path and the pair of discharging rollers 47 to the discharging tray 48 to be stacked thereon.

The switchback unit 46 is disposed below the fixing unit 43 and the sheet conveyance belt unit 39. If the switching claw 49 is set to direct to the switchback path, the recording sheet conveyed from the fixing unit 43 passes through the switchback path where the recording sheet is reversed upside down to the switchback unit 46. Then, the recording sheet enters the secondary transfer nip again so that the secondary transfer process and the fixing process are performed for a toner image formed on the back side thereof.

The scanner 160 is fixedly mounted on the printing section 120 to serve as an image reading device for reading original documents. The scanner 160 includes a fixed reading unit 161 and a movable reading unit 162.

The fixed reading unit 161 includes a light source, reflection mirrors, image reading sensors such as charge-coupled devices (CCDs), and so forth. The fixed reading unit 161 is located directly below a first contact glass, not illustrated, which is fixedly mounted on a casing upper wall of the scanner 160 so as to contact the original documents directly. When an original document that is conveyed by the ADF 170 slidably passes on the first contact glass, light emitted by the light source is reflected on the surface of the original document sequentially via multiple reflection mirrors, and the reflected light is received by the image reading sensor. By so doing, the original document is optically scanned without moving optical units and components such as the light source and the reflection mirrors.

By contrast, the movable reading unit 162 is located directly below a second contact glass, not illustrated, which is fixedly mounted on the casing upper wall of the scanner 160 so as to directly contact the original documents, and enables optical components and units such as light source and reflection mirrors to move from side to side in FIG. 2. As the optical components and units of the movable reading unit 162 move from the left side to the right side of FIG. 2, the laser light beam emitted from the light source is reflected on an original document, not illustrated, placed on the second contact glass, then travels via multiple reflection mirrors, and is received by the fixed reading unit 161 of the scanner 160. Thus, the original document is scanned while the optical components and units are being moved.

Figure 5:
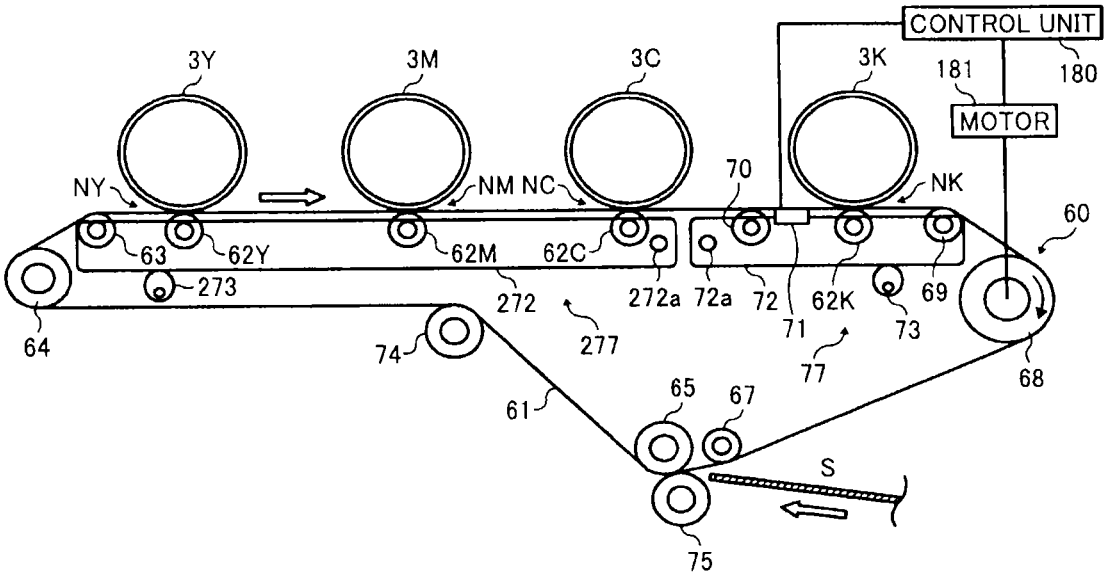
FIG. 5 is an enlarged view of a transfer unit under a condition in which an intermediate transfer belt is held in contact with four photoconductors.

Next, a description is given of the transfer unit 60 and the photoconductors 3Y, 3M, 3C, and 3K, in reference to FIG. 5 illustrating an enlarged view of the transfer unit 60 and the photoconductors 3Y, 3M, 3C, and 3K.

In FIG. 5, the intermediate transfer belt 61 rotates endlessly in a clockwise direction while being supported by eleven (11) belt supporting rollers that serve as a plurality of M belt supporting members arranged on the inner surface of the intermediate transfer belt 61. The number of the plurality of M belt supporting members is greater than the number of the plurality of N image carriers, satisfying a relation of M>N.

To reduce the size of a belt tensioned area of the intermediate transfer belt 61, a belt pressing roller 74 presses against the intermediate transfer belt 61 in the tensioned area to bend and form a recessed portion toward the inside of the loop of the intermediate transfer belt 61 at the lower left part of FIG. 5.

These eleven belt supporting rollers that support the intermediate transfer belt 61 on the inner surface thereof are four primary transfer rollers 62Y, 62M, 62C, and 62K, a nip array entrance roller 63, a tension roller 64, a transfer roller opposing roller 65, a secondary transfer nip entrance roller 67, a drive roller 68, a nip array exit roller 69, and a nip array pre-exit roller 70.

The primary transfer nip for black toner image is the extreme downstream transfer nip of the four primary transfer nips in the primary transfer operation. Further, the primary transfer nip for yellow toner image is the extreme upstream transfer nip of the four primary transfer nips in the primary transfer operation. For the image forming apparatus 1, the primary transfer roller 62K supports the intermediate transfer belt 61 from the inner surface at the extreme downstream transfer nip. The primary transfer rollers 62Y, 62M, 62C, and 62K are referred to as nip opposing members. In the image forming apparatus 1 according to an exemplary embodiment of the present invention, the primary transfer roller 62K may be also referred to as a first nip opposing member and the primary transfer roller 62Y may be also referred to as an Nth nip opposing member.

The primary transfer roller 62Y serving as the Nth nip opposing member is disposed adjacent to the nip array entrance roller 63 that serves as an extreme upstream belt supporting member. The nip array entrance roller 63 is disposed adjacent to and upstream from the primary transfer roller 62Y in a direction of rotation of the intermediate transfer belt 61. The nip array exit roller 69 serving as an extreme downstream belt supporting member is disposed adjacent to and downstream from the primary transfer roller 62K serving as the first nip opposing member in a direction of rotation of the intermediate transfer belt 61. Further, the nip array pre-exit roller 70 serving as a second upstream belt supporting member is disposed adjacent to and upstream from the primary transfer roller 62K in a direction of rotation of the intermediate transfer belt 61.

The nip array pre-exit roller 70, the primary transfer roller 62K, and the nip array exit roller 69 are arranged sequentially in this order and held by a first bracket 72 that serves as a retaining unit and a first sub-retainer.

The transfer unit 60 includes a first contact and separation unit 77 that is formed by a first eccentric cam 73 and a first cam motor, not illustrated, for driving the first eccentric cam 73. The first contact and separation unit 77 serving as a contact and separation mechanism swingably moves the first bracket 72 by changing the position where the first eccentric cam 73 abuts against the first bracket 72 that swings about a swing shaft 72*a* according to movement of the first eccentric cam 73. This action of the first bracket 72 moves the primary transfer roller 62K that is held by the first bracket 72 to a direction close to the photoconductor 3K or a direction away from the photoconductor 3K. By so doing, the intermediate transfer belt 61 can be moved into and out of contact with the photoconductor 3K. With this action of the first contact and separation unit 77, the shape of a first tensioned area of the intermediate transfer belt 61 in the circumferential thereof where the primary transfer roller 62K contacts and supports the intermediate transfer belt 61 at the upper right part of FIG. 5 may vary. However, the tension roller 64 that is urged in a direction toward the inner surface of the intermediate transfer belt 61 while being slidably held by a bracket, not illustrated, can prevent a significant fluctuation of the tension force of the intermediate transfer belt 61 by moving the tension roller 64 flexibly according to the shape change of the first tensioned area of the intermediate transfer belt 61.

Further, the nip array entrance roller 63, the primary transfer rollers 62Y, 62M, and 62C are arranged sequentially in this order and held by a second bracket 272 that serves as a retaining unit and a second sub-retainer.

Figure 6:
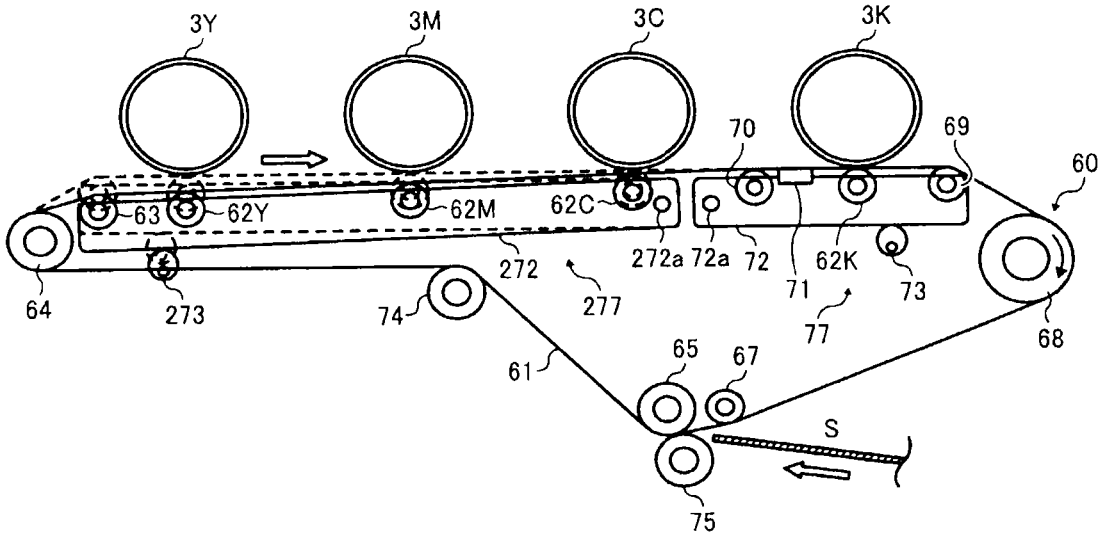
FIG. 6 is an enlarged view of the transfer unit under a condition in which the intermediate transfer belt is held in contact with one photoconductor.

The transfer unit 60 includes a second contact and separation unit 277 that is formed by a second eccentric cam 273 and a second cam motor, not illustrated, for driving the second eccentric cam 273. The second contact and separation unit 277 serving as a contact and separation mechanism swingably moves the second bracket 272 by changing the position where the second eccentric cam 273 abuts against the second bracket 272 that swings about a swing shaft 272*a* according to movement of the second eccentric cam 273. This action of the second bracket 272 moves the primary transfer rollers 62Y, 62M, and 62C that are held by the second bracket 272 to a direction close to the photoconductors 3Y, 3M, and 3C, respectively, or to a direction away from the photoconductors 3Y, 3M, and 3C, respectively, as shown in FIG. 6. By so doing, the intermediate transfer belt 61 can be moved into and out of contact with the photoconductors 3Y, 3M, and 3C. With this action of the second contact and separation unit 277, the shape of a second tensioned area of the intermediate transfer belt 61 in the circumferential thereof where the primary transfer rollers 62Y, 62M, and 62C contact and support the intermediate transfer belt 61 at the upper left part of FIG. 6 may vary. However, the tension roller 64 can prevent a significant fluctuation of the tension force of the intermediate transfer belt 61 by moving the tension roller 64 flexibly according to the shape change of the second tensioned area of the intermediate transfer belt 61.

When the image forming apparatus 1 according to an exemplary embodiment of the present invention performs image forming operations in a color printing mode, the photoconductors 3Y, 3M, 3C, and 3K contact the intermediate transfer belt 61, as shown in FIG. 5, so that the transfer nips for yellow image, magenta image, cyan image, and black image can be formed. Then, as the process units 2Y, 2M, 2C, and 2K develop respective toner images, the toner images are sequentially transferred from the photoconductors 3Y, 3M, 3C, and 3K onto the intermediate transfer belt 61 to form an overlaid or composite color toner image.

By contrast, when the image forming apparatus 1 according to an exemplary embodiment of the present invention performs image forming operations in a monochrome printing mode, the photoconductors 3Y, 3M, and 3C are separated from the intermediate transfer belt 61 so that only the photoconductor 3K contacts the intermediate transfer belt 61, as shown in FIG. 6. Then, as only the process unit 3K develops a black toner image while the photoconductors 3Y, 3M, and 3C are not in operation, the black toner image is transferred from the photoconductor 3K onto the intermediate transfer belt 61.

As noted above, the photoconductors 3Y, 3M, and 3C are separated from the intermediate transfer belt 61 and do not perform the image forming operation in the monochrome mode, which can avoid a decrease in mechanical lives of the photoconductors 3Y, 3M, and 3C caused by unnecessary operations. Further, the photoconductor 3 does not contact the intermediate transfer belt 61 unnecessarily in this configuration, thereby avoiding a decrease in time period of mechanical lives of the photoconductors 3Y, 3M, and 3C and the intermediate transfer belt 61.

Figure 7:
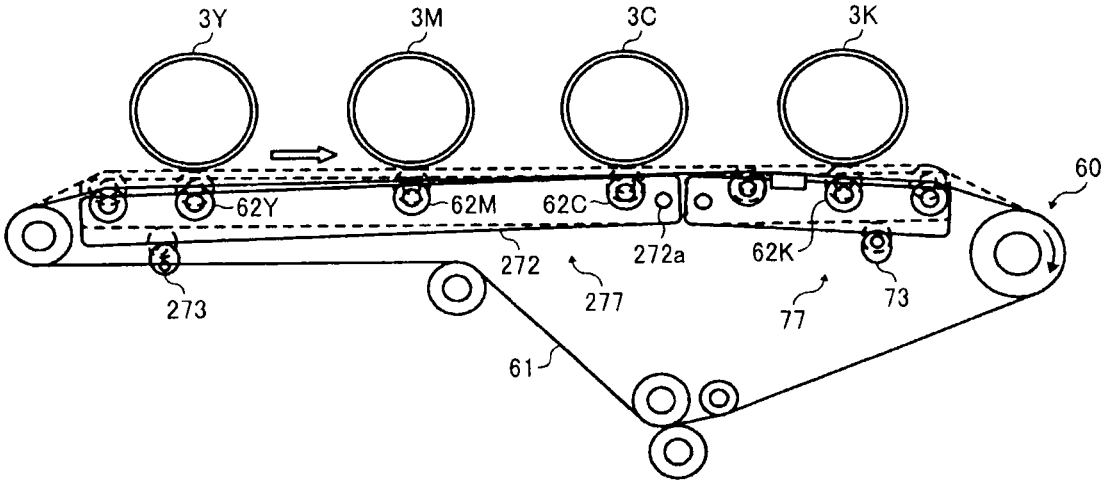
FIG. 7 is an enlarged view of the transfer unit under a condition in which the intermediate transfer belt is completely separated from the four photoconductors.

Further, when the image forming apparatus 1 according to an exemplary embodiment of the present invention stops the image forming operations, the photoconductors 3Y, 3M, 3C, and 3K are completely separated from the intermediate transfer belt 61, as shown in FIG. 7. By so doing, the photoconductors 3Y, 3M, 3C, and 3K and the intermediate transfer belt 61 do not contact to each other unnecessarily when the image forming apparatus 1 is not in operation, and therefore a decrease in time period of mechanical lives of the photoconductors 3Y, 3M, 3C, and 3K and the intermediate transfer belt 61 does not occur.

A scale, not illustrated, is arranged at one end in a widthwise direction of the intermediate transfer belt 61. The scale has multiple marks formed at a predetermined pitch or intervals on the intermediate transfer belt 61 in a circumferential direction or a direction of rotation of the intermediate transfer belt 61. The multiple marks of the scale are detected by a scale sensor 71 that includes a reflective photosensor arranged on the inner surface of the intermediate transfer belt 61. The scale sensor 71 serves as a mark detector to output a detection signal of each mark of the multiple marks to a control unit 180 that serves as a controller.

The image forming apparatus 1 according to an exemplary embodiment of the present invention further includes the control unit 180, as shown in FIG. 5. The control unit 180 includes a central processing unit (CPU), a random access memory (RAM), a read-only memory (ROM), and so forth and controls the entire units and components of the image forming apparatus 1.

The control unit 180 calculates and obtains a speed of rotation of the intermediate transfer belt 61 based on a time interval of a mark detection signal that is transmitted from the scale sensor 71. Then, based on the calculation results, the control unit 180 drives a belt drive motor 181 that is connected to the control unit 180, according to a drive speed pattern that has an inverted phase with respect to a fluctuation of speed of the intermediate transfer belt 61. By so doing, a feed back control can be preformed to suppress the velocity fluctuation of the intermediate transfer belt 61. The illustration of the control unit 180 and the belt drive motor 181 are omitted in FIGS. 6 and 7.

Next, a description is given of detailed configuration and operations of the image forming apparatus 1 according to an exemplary embodiment of the present invention.

As previously shown in FIG. 5 illustrating the image forming apparatus 1 according to an exemplary embodiment of the present invention, the scale sensor 71 that serves as a mark detector is fixedly mounted on the first bracket 72 that serves as a retaining unit and a first sub-retainer. In FIG. 5, the mark detection surface of the scale sensor 71 is disposed facing up at a tensioned area defined by and between the nip array pre-exit roller 70 and the primary transfer roller 62K on the inner surface of the intermediate transfer belt 61 across a predetermined gap formed therebetween. The scale sensor 71 detects the multiple marks of the scale formed on the intermediate transfer belt 61 in a mark detection range defined by the nip array pre-exit roller 70 and the nip array exit roller 69, extending from an area supported by the nip array pre-exit roller 70 to an area supported by the nip array exit roller 69.

The scale sensor 71 is retained by the first bracket 72, together with the primary transfer roller 62K that supports the intermediate transfer belt 61 at the transfer nip NK for black toner image from the inner surface of the intermediate transfer belt 61, and detects the multiple marks on the intermediate transfer belt 61 in the vicinity of the primary transfer nip NK. According to the configuration, the speed of the intermediate transfer belt 61 in the primary transfer nip NK can be detected accurately.

Since the nip array pre-exit roller 70, the primary transfer roller 62K, and the scale sensor 71 are retained by the first bracket 72, the gap formed between the tensioned area on the inner surface of the intermediate transfer belt 61 and the mark detection surface of the scale sensor 71 can remain constant, regardless of the operation of the first bracket 72. That is, regardless of the contact and separation operation performed by the first contact and separation unit 77, color shift caused by fluctuation of the velocity of the intermediate transfer belt 61 can be prevented accurately.

As noted above, the scale sensor 71 is fixedly mounted on the first bracket 72 to detect the multiple marks of the scale formed on the inner surface of the intermediate transfer belt 61. However, the scale sensor 71 can be fixedly mounted on the first bracket 72 to detect a scale formed on the outer surface of the intermediate transfer belt 61 by using a C-shaped steel. In this case, the scale on the outer surface of the intermediate transfer belt 61 is preferably arranged outside the image forming area in the widthwise direction thereof.

Further, the configuration described above uses the scale that is previously printed on the intermediate transfer belt 61. However, as an alternative to the previously printed scale, the scale can include multiple patch toner images to be formed on the outer surface of the intermediate transfer belt 61 by a process unit of any toner color. For example, the patch toner images disclosed in JPAP 2004-177507 can be employed.

As described above, the image forming apparatus 1 according to an exemplary embodiment of the present invention includes the first contact and separation unit 77 in which the photoconductor 3K contacts and separates from the intermediate transfer belt 61 by moving the first bracket 72 into and out of contact with the intermediate transfer belt 61 and the second contact and separation unit 277 in which the photoconductors 3Y, 3M, and 3C contact and separate from the intermediate transfer belt 61 by moving the second bracket 272 into and out of contact with the intermediate transfer belt 61.

As an alternative configuration, the scale sensor 71 can be fixedly mounted on the second bracket 272. However, it is preferable that the scale sensor 71 is fixedly mounted on the first bracket 72 to achieve the following effect. The color that can effectively suppress the deformation of toner image due to fluctuation of the velocity of the intermediate transfer belt 61 can be determined depending on which primary transfer nip of the four primary transfer nips NY, NM, NC, and NK are arranged at predetermined intervals in a straight line comes closest to the first bracket 72.

When the scale sensor 71 is fixedly mounted on the first bracket 72, the speed of the intermediate transfer belt 61 can be detected most accurately at the primary transfer nip NK, thereby suppressing the distortion of the black toner image most effectively. In general the black color toner is highly frequently used. Therefore, by fixedly mounting the scale sensor 71 on the first bracket 72, the distortion of the black toner image that is most frequently output can be suppressed most effectively.

Further, the distance between the scale sensor 71 and the mark detection range of the intermediate transfer belt 61 can maintain constant regardless of the contact and separation operation performed by the first contact and separation unit 77. By so doing, the intermediate transfer belt 61 can be free of bend or damage caused by the scale sensor 71 abutting against the intermediate transfer belt 61, for example.

In the image forming apparatus 1 according to an exemplary embodiment of the present invention, the scale sensor 71 is fixedly mounted on the first bracket 72. However, different from this configuration, the speed of the intermediate transfer belt 61 can be detected accurately at the primary transfer nip NK either in the color mode or in the monochrome mode if the scale sensor 71 is provided in proximity to either the entrance or the exit of the primary transfer nip NK on the outer surface of the intermediate transfer belt 61.

However, when the first bracket 72 is moved away from the photoconductor 3K to move the intermediate transfer belt 61 out of contact with the photoconductor 3K, the intermediate transfer belt 61 may be separated significantly from the scale sensor 71. Therefore, when the intermediate transfer belt 61 is separated from the photoconductor 3K, the speed of the intermediate transfer belt 61 cannot be detected.

In recent years, a reduction in a rising time from the idling state to the printing state has been required, and therefore it may be required to detect the speed of the intermediate transfer belt 61 even when the intermediate transfer belt 61 is separated from the photoconductor 3K.

In the image forming apparatus 1 according to an exemplary embodiment of the present invention, the distance between the intermediate transfer belt 61 and the mark detection surface of the scale sensor 71 can be retained to be substantially equal, regardless of the movement of the first bracket 72. Therefore, even during the movement of the first bracket 72, the intermediate transfer belt 61 can contact or separate from the photoconductor 3K, and the scale sensor 71 can detect the multiple marks of the scale formed on the intermediate transfer belt 61.

The nip array entrance roller 63 that serves as the extreme upstream belt supporting member is disposed adjacent to and upstream from the primary transfer roller 62Y that supports the intermediate transfer belt 61 on the inner surface thereof where the primary transfer nip NY that corresponds to the extreme upstream nip of the four (or N) primary transfer nips NY, NM, NC, and NK. Further, the nip array exit roller 69 that serves as the extreme downstream belt supporting member is disposed adjacent to and downstream from the primary transfer roller 62K that serves as the extreme downstream belt supporting member in a direction of rotation of the intermediate transfer belt 61.

The transfer unit 60 holds the intermediate transfer belt 61 tensioned in a straight line, extending from an area supported by the nip array entrance roller 63 to an area supported by the nip array exit roller 69 in the direction of rotation of the intermediate transfer belt 61, as shown in FIG. 5. In this configuration, an angle of approach to the primary transfer nip or a belt nip approach angle at the entrance of each primary transfer nip is set to be equal. Further, an angle of exit from the primary transfer nip or a belt nip exit angle at the exit of each primary transfer nip is also set to be equal. As a result, the primary transfer condition at or in proximity to each primary transfer nip is provided to be equal to reduce or prevent errors in the transferability of each color.

Further, in the image forming apparatus 1 according to an exemplary embodiment of the present invention, the first bracket 72 retains the nip array pre-exit roller 70 that serves as the second upstream belt supporting member as well as the nip array exit roller 69 that serves as the extreme downstream belt supporting member. With this configuration, by moving the nip array pre-exit roller 70, the primary transfer roller 62K, and the nip array exit roller 69 together by integrally mounting on the first bracket 72, the tensioned area from the entrance of the primary transfer nip NK to the exit of the primary transfer nip NK can remain in a straight line as shown in FIG. 5, regardless of the contact and separation operations performed by the first contact and separation unit 77 and the second contact and separation unit 277. Therefore, regardless of the contact and separation operations performed by the first contact and separation unit 77 and the second contact and separation unit 277, the belt nip approach angle at the entrance of the primary transfer nip NK and the belt nip exit angle at the exit of the primary transfer nip NK can remain constant. Accordingly, regardless of the contact and separation operations, a constant transfer condition can be maintained at, before, or after the primary transfer nip NK.

The description above has been given of the image forming apparatus 1 in which toner images formed on the respective photoconductors 3Y, 3M, 3C, and 3K are successively transferred onto the surface of the intermediate transfer belt 61. However, the technique of the present invention can also be applied to an image forming apparatus that has a configuration in which toner images formed on respective photoconductors are sequentially transferred and overlaid onto a recording medium carried on the surface of an endless belt member.

Further, the description above has been given of the image forming apparatus 1 in which the scale sensor 71 is fixedly mounted on the first bracket 72. However, the technique of the present invention can also be applied to an image forming apparatus having a configuration in which a patch detection sensor is fixedly mounted on a bracket (e.g., the first bracket 72). The patch detection sensor can detect patch images formed on the surface of a belt member using a color shift correction control. With the color shift correction control, the angles of the optical components and unit can be adjusted and the times of optical writing can be changed so as to correct color shifting caused by deviation of a small optical path or paths in an optical system (e.g., the optical writing unit 50) due to change in temperature. To grasp a color shift amount of each color, the patch detection sensor is used to detect the patch images formed on the surface of the belt member.

As described above, the image forming apparatus 1 according to an exemplary embodiment of the present invention includes the primary transfer roller 62K to serve as a first nip opposing member of the multiple belt supporting members and provides the primary transfer roller 62K to support the intermediate transfer belt 61 from the inner surface at the extreme downstream transfer nip. The image forming apparatus 1 further includes the first contact and separation unit 77 and the second contact separation unit 277. The first contact and separation unit 77 swingably moves the first bracket 72 serving as the retaining unit and the first sub-retainer by moving the first tensioned area of the intermediate transfer belt 61 defined by the primary transfer roller 62K into and out of contact with the photoconductor 3K that is disposed facing the primary transfer roller 62K with the intermediate transfer belt 61 interposed therebetween. The second contact and separation unit 277 swingably moves the second bracket 272 serving as the retaining unit and the second sub-retainer by moving the second tensioned area of the intermediate transfer belt 61 defined by the primary transfer rollers 62Y, 62M, and 62C into and out of contact with the photoconductors 3Y, 3M, and 3C that are disposed facing the primary transfer rollers 62Y, 62M. and 62C with the intermediate transfer belt 61 interposed therebetween. Further, a black toner image is transferred from the photoconductor 3K onto the outer surface of the intermediate transfer belt 61 at the extreme downstream transfer nip. With this configuration, the black toner image that is most frequently produced for image forming and printing can be effectively prevented from the shape change caused by the fluctuation of the velocity of the intermediate transfer belt 61.

Further, in the image forming apparatus 1 according to an exemplary embodiment of the present invention, the nip array entrance roller 63 is fixedly mounted on the second bracket 272 so that the nip array entrance roller 63 is disposed adjacent to and upstream from the primary transfer roller 62Y in a direction of rotation of the intermediate transfer belt 61, where the primary transfer roller 62Y is supports the intermediate transfer belt 61 on the inner surface thereof and the primary transfer roller 62Y and the photoconductor 3Y form the extreme upstream transfer nip with the intermediate transfer belt 61 interposed therebetween. In addition, the nip array exit roller 69 is fixedly mounted on the first bracket 72 so that the nip array exit roller 69 is disposed adjacent to and downstream from the primary transfer roller 62K serving as the first nip opposing member in a direction of rotation of the intermediate transfer belt 61. Further, the intermediate transfer belt 61 tensioned in a straight line by and between the nip array entrance roller 63 disposed adjacent to and upstream from the primary transfer roller 62Y and the nip array exit roller 69 disposed adjacent to and downstream from the primary transfer roller 62K in the direction of rotation of the intermediate transfer belt 61. With this configuration, each condition of the transfer nips NY, NM, NC, and NK can be provided to be equal to reduce or prevent errors of the transferability of each color.

Further, in the image forming apparatus 1 according to an exemplary embodiment of the present invention, the nip array pre-exit roller 70 is adjacent to and upstream from the primary transfer roller 62K in the direction of rotation of the intermediate transfer belt 61 and is fixedly mounted on the first bracket 72. With this configuration, regardless of the contact and separation operation performed by the first contact and separation unit 77 and the second contact and separation unit 277, the belt nip approach angle at the entrance of the primary transfer nip NK and the belt nip exit angle at the exit of the primary transfer nip NK can be set to be equal. Accordingly, regardless of the operations of the first contact and separation unit 77 and the second contact and separation unit 277, a constant transfer condition can be maintained at, before, or after the primary transfer nip NK.

Further, in the image forming apparatus 1 according to an exemplary embodiment of the present invention, the scale sensor 71 is fixedly mounted on the first bracket 72 so as to detect the multiple marks of the scale formed on the intermediate transfer belt 61 while the multiple marks pass through a mark detection range that is defined by and extends from an area supported by the nip array pre-exit roller 70 to an area supported by and the nip array exit roller 69 in the direction of rotation of the intermediate transfer belt 61. With this configuration, the velocity of surface of the intermediate transfer belt 61 at the primary transfer nip NK can be detected with accuracy.

Further, in the image forming apparatus 1 according to an exemplary embodiment of the present invention, the multiple marks are arranged on the inner surface of the intermediate transfer belt 61, and the scale sensor 71 is fixedly mounted on the first bracket 72 to detect the multiple marks in the mark detection range on the inner surface of the intermediate transfer belt 61. With this configuration, the positions of units and components around the intermediate transfer belt 61 of the transfer unit 60 can be more flexibly arranged, compared with the configuration in which the scale sensor 71 is disposed on the outer surface of the intermediate transfer belt 61.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image carrier configured to carry a toner image thereon;

a belt configured to contact the image carrier;

first and second end rollers which support the belt and around which the belt is wrapped;

a first intermediate roller configured to support the belt;

a second intermediate roller disposed downstream from the first intermediate roller in a moving direction of the belt and configured to support the belt;

a detector disposed downstream from the first intermediate roller and upstream from the second intermediate roller in the moving direction of the belt and configured to detect a mark formed on the belt;

a supporter configured to support the detector, the first intermediate roller and the second intermediate roller; and a contact and separation mechanism configured to move the supporter between a first position and a second position, the belt contacting the image carrier when the supporter is in the first position and being separate from the image carrier when the supporter is in the second position, the contact and separation mechanism arranged so that movement thereof moves the detector, the first intermediate roller, and the second intermediate roller without moving the first end roller or the second end roller.

2. The image forming apparatus according to claim 1, wherein the detector detects the mark at a tensioned area of the belt between the first intermediate roller and the second intermediate roller.

3. The image forming apparatus according to claim 2, wherein, when the contact and separation mechanism moves the supporter from the first position to the second position, a gap between the tensioned area of the belt and a mark detection surface of the detector remains constant.

4. The image forming apparatus according to claim 1, wherein the first intermediate roller and the second intermediate roller contact an inner surface of the belt.

5. The image forming apparatus according to claim 4, further comprising:

a drive roller that drives the belt; and a tension roller that applies a belt tension to the belt, wherein the first intermediate roller and the second intermediate roller are disposed downstream from the tension roller and upstream from the drive roller in the moving direction of the belt.

6. The image forming apparatus according to claim 1, wherein, when the contact and separation mechanism moves the supporter from the second position to the first position, the first intermediate roller and the second intermediate roller project in a thickness direction of the belt.

7. The image forming apparatus according to claim 1, further comprising a transfer roller disposed opposite to the image carrier via the belt.

8. The image forming apparatus according to claim 7, wherein the transfer roller is disposed downstream from the first intermediate roller and upstream from the second intermediate roller in the moving direction of the belt.

9. The image forming apparatus according to claim 1, wherein the supporter is disposed inside a loop of the belt.

10. The image forming apparatus according to claim 1, wherein the detector is fixed to the supporter.

11. The image forming apparatus according to claim 1, wherein the mark includes a plurality of adjacent marks formed at predetermined pitches on the belt in the moving direction of the belt.

12. The image forming apparatus according to claim 1, wherein the contact and separation mechanism includes an eccentric cam that contacts the supporter.

* * * * *